United States Patent [19]

Brisco

[11] Patent Number: 5,071,288

[45] Date of Patent: Dec. 10, 1991

[54] SUBSEA INFLATION AND GROUT SYSTEM

[75] Inventor: David P. Brisco, Duncan, Okla.

[73] Assignee: Halliburton Company, Duncan, Okla.

[21] Appl. No.: 367,834

[22] Filed: Jun. 19, 1989

[51] Int. Cl.[5] ..... E02B 17/00; E02D 5/14

[52] U.S. Cl. ..... 405/225; 405/224; 405/227; 137/70

[58] Field of Search ..... 405/195, 223, 224, 225, 405/227; 137/70

[56] References Cited

U.S. PATENT DOCUMENTS

| | | | |
|---|---|---|---|
| 3,209,544 | 10/1965 | Borrmann . | |
| 3,213,629 | 10/1965 | Manning . | |
| 3,315,473 | 4/1967 | Hauber et al. . | |
| 3,429,133 | 2/1969 | Hauber . | |
| 3,443,572 | 5/1969 | Lavigne et al. | 137/70 |
| 3,466,878 | 9/1969 | Esquillan et al. . | |
| 3,564,856 | 2/1971 | Blount et al. . | |
| 3,601,999 | 8/1971 | Olsen et al. . | |
| 3,811,289 | 5/1974 | Bassett . | |
| 3,838,575 | 10/1974 | Clark et al. . | |
| 3,839,872 | 10/1974 | Loire . | |
| 3,878,687 | 4/1975 | Tragesser, Jr. . | |
| 4,009,581 | 3/1977 | Britton et al. . | |
| 4,063,421 | 12/1977 | Coone et al. . | |
| 4,070,869 | 1/1978 | Williams . | |
| 4,077,224 | 3/1978 | Coone . | |
| 4,140,426 | 2/1979 | Knox | 405/225 |
| 4,171,923 | 10/1979 | Landers | 405/225 |
| 4,191,494 | 3/1980 | Nakamura et al. | 405/171 |
| 4,240,767 | 12/1980 | Garcia | 405/227 |
| 4,275,974 | 6/1981 | Knox et al. | 405/225 |
| 4,696,602 | 9/1987 | Daigle, Sr. et al. | 405/205 |
| 4,772,158 | 9/1988 | Coone | 405/227 |
| 4,776,727 | 10/1988 | Saffrhan | 405/225 |

FOREIGN PATENT DOCUMENTS

| | | | |
|---|---|---|---|
| 1254836 | 1/1961 | France | 137/70 |
| 2096674 | 8/1984 | United Kingdom . | |
| 2168407 | 6/1986 | United Kingdom . | |

OTHER PUBLICATIONS

Exhibit A–Drawing of Inflation Check Valve/Inflation Control Valve.

Halliburton Services Sales Brochure SS-103, "Unitrol Manifold".

Halliburton Services Brochure C-1247, "Advanced Materials and Techniques Make Halliburton Your Best Choice for Offshore Platform Grouting".

Halliburton Services Sales & Service Catalog No. 43, pp. 2590–2591, published in 1985.

*Primary Examiner*—Dennis L. Taylor

*Assistant Examiner*—John A. Ricci

*Attorney, Agent, or Firm*—James R. Duzan; Neal R. Kennedy

[57] ABSTRACT

A subsea inflation and grout system for use on subsea supports of offshore drilling platforms and the like. The system includes at least one grout control valve and at least one inflation control valve, each of which has a piston therein with a side always exposed to hydrostatic pressure from the sea when submerged. In the event of damage to the grout line to the grout control valve or the inflation line to the inflation control valve, the piston in the valve is pressure balanced so that hydrostatic pressure cannot prematurely or accidentally move the piston. The piston in the grout control valve is held in place by a shear pin. The piston in the grout control valve is held in place by a spring. The piston in the inflation control valve further defines a passage therethrough, and a check valve is disposed in the passage for preventing fluid flow from the outlet of the inflation control valve to the inlet even when the piston is in an open position.

25 Claims, 4 Drawing Sheets

SUBSEA INFLATION AND GROUT SYSTEM

BACKGROUND OF THE INVENTION

1. Field Of The Invention

This invention relates to inflation and grouting systems for offshore drilling platforms and the like, and more particularly, to such a system having grout and inflation control valves which use pressure balancing to prevent inadvertent opening by hydrostatic pressure in the grout or inflation lines.

2. Description Of The Prior Art

On offshore drilling platforms, it is necessary to secure the legs of the platform to the ocean floor, and a number of methods have been developed to do this. In the typical procedure, a plurality of jacket legs are set on bottom. Each jacket leg is flanked by a plurality of skirt jackets or sleeves which are attached to the jacket leg and set on bottom at substantially the same time as an assembly. The jacket leg is a structural member of the offshore platform or tower that extends from the sea bottom to the working deck above sea level. The skirt jacket or sleeve is a jacket or sleeve which is structurally attached to the jacket leg and extends only partially from the sea bottom toward sea level. After the jacket leg and skirt sleeves are set on bottom, piles are driven through each into the sea bed. The pile is smaller in diameter so that an annulus is defined therearound. A leg pile is any pile placed through the jacket leg, and a skirt or sleeve pile is any pile placed through the skirt jacket or sleeve.

A similar structure is found on the more recently developed tension leg platforms. With these platforms, a template is positioned on the ocean floor with a floating platform located thereabove. Anchoring members extend from the platform to the template to hold the platform in its operating position. The anchor members are always in tension and allow some side-to-side movement of the platform, although the platform is prevented from rising and falling with the swells of the ocean. The tension leg platform template has a plurality of skirt sleeves. There are no jacket legs. As with a conventional offshore platform, piles are driven into the skirt sleeves such that an annulus is defined between each pile and the corresponding skirt sleeve.

Inflation packers are positioned in the annulus at the bottom of each jacket leg and skirt sleeve and are inflated once the piles are in place. The inflated packers bridge the gap between the pile and jacket leg or skirt sleeve, sealing the lower end of the annular space formed therebetween. Grout is then pumped into the annular space between the pile and jacket leg or skirt sleeve to fill the annular space and displace the water therein. The grout enters above the packer.

U.S. Pat. No. 4,140,426 to Knox, assigned to the assignee of the present invention, discloses a system for inflating packers and placing grout through one line in offshore platforms. This prior art apparatus includes a sleeve valve which is the same type of valve identified herein as a sleeve grouting valve. The Knox apparatus includes inflation check and control valves and grout check and control valves. In one prior art embodiment, the inflation check and control valves are contained in one integrated body. However, whether in an integrated body or as separate components, the function is substantially identical.

U.S. Pat. No. 4,275,976 to Knox and Sullaway, also assigned to the assignee of the present invention, shows another inflation and grout system which uses essentially the same components as the Knox patent, but also includes separate inflation and grout lines.

The prior art grout control valves shown in the Knox patent and the Knox and Sullaway patent are pressure actuated valves located near the bottom of the grout lines at the point where the corresponding line enters a jacket leg or skirt sleeve. The valves prevent water from flooding the jacket leg or skirt sleeve should the grout line develop a leak, rupture, or be torn off the platform or jacket during launch or installation thereof. The prior art grout control valves compare a piston held inside a body with a shear pin. The piston closes off the grout line to the jacket leg or skirt sleeve. The piston and shear pin are individually sized for the water depth at which the valve will be used so the pressure will not shift if exposed to hydrostatic pressure. The top of the piston is exposed to the pressure in the grout line, and the bottom of the piston is exposed to the pressure in the leg or skirt sleeve. The grout lines, jacket legs and skirt sleeves are sealed to provide flotation for the platform or template during launch and installation. The pressure inside the grout lines, jacket legs and skirt sleeves is typically atmospheric.

If the grout line develops a leak, ruptures, or is torn off, the top of the piston becomes exposed to hydrostatic pressure and is pushed against the shear pin. The shear pin prevents the piston from shifting and allowing water to prematurely flood the jacket leg or skirt sleeve. Premature flooding of the jacket leg or skirt sleeve can cause the platform or template to sink.

During normal grouting operations, the grout line is filled with water or grout, and pressure is applied to shift the piston. A loss of pressure in the line indicates when the shear pin is sheared and the piston shifted, thereby opening the grout line to the jacket leg or skirt sleeve. Grout can then be pumped into the jacket leg or skirt sleeve.

The prior art inflation check valve and inflation control valve are pressure actuated valves, and as previously indicated, may be in the form of a pressure actuated combination valve. The valves are located on the outside of jacket legs or skirt sleeves adjacent to the packers. The inflation control valves are in communication with the packers and are connected to packer inflation lines. The inflation control valves prevent water from prematurely inflating the packer should the inflation line develop a leak, rupture or be torn off the platform or template during launch or installation thereof. Because initially there is not a pile in place for the packer to inflate against, the packer will burst and the jacket leg or skirt sleeve will be flooded if the packer is prematurely inflated. Inflation control valves also prevent the inflation pressure in the packer from bleeding off if there were to be a leak in the inflation line.

The prior art inflation control valve comprises a piston held inside a body with a shear pin, similar to the grout control valve previously described. The piston in the inflation control valve closes off the inflation line to the packer. The piston and shear pin are individually sized for the water depth at which the valve will be used so the piston will not shift if exposed to hydrostatic pressure. In a manner similar to the grout control valve, the top of the piston in the inflation control valve is exposed to the pressure in the inflation line, and the bottom of the piston is exposed to the pressure between it and the inflation check valve, which is the same as the original pressure in the packer. The initial pressure inside the inflation lines and packers is typically atmospheric.

The prior art inflation check valve is a spring actuated poppet type valve. It opens to allow the inflation fluid to flow into, and inflate, the packer, then closes off to retain the inflation pressure in the packer should the pressure in the inflation line drop.

If the inflation line develops a leak, ruptures or is torn off, the top of the piston in the inflation control valve becomes exposed to hydrostatic pressure and is pushed against the shear pin. The shear pin prevents the piston from shifting and allowing water to prematurely inflate the packer.

Under normal conditions, the inflation line is filled with water or compressed gas, and pressure is applied to shift the piston in the inflation control valve, shearing the shear pin and opening the inflation line to the packer. Water or compressed gas can then be pumped past the inflation check valve into the packer to inflate it against the previously driven pile.

Both the prior art grout control valve and prior art inflation control valve rely completely on the shear pin to keep the piston in the control valve from shifting if the piston is exposed to hydrostatic pressure. If a valve is mishandled during shipment, installation or launch, the shear pin may be damaged enough to allow the piston to shift prematurely if exposed to hydrostatic pressure. Also, materials used to make the shear pin may degrade over time, causing reduction in the shear strength of the shear pin and allowing the piston to shift prematurely if exposed to hydrostatic pressure.

The improved control valve of the present invention is designed so that hydrostatic pressure in the grout line cannot shift the piston because the bottom of the piston is always exposed to hydrostatic pressure. Further, in the present invention, if the piston were shifted before or during launch of the jacket, the hydrostatic pressure will shift the piston back to its closed position. In the inflation control valve, a spring force is also applied to the piston. In the inflation valve of the present invention, the inflation check valve is built into the piston of the inflation control valve, thus greatly simplifying the assembly and eliminating the need for separate valves.

SUMMARY OF THE INVENTION

The subsea inflation and grout system of the present invention is adapted for use on subsea supports for offshore drilling platforms and the like and comprises grout and inflation control valves.

Each of the control valves comprises a body defining an inlet connectable to a pressure line, such as a grout line or inflation line, and further defining an outlet. The control valves further comprise piston means for moving within the body and providing communication between the inlet and outlet when in an open position and preventing communication between the inlet and outlet when in a closed position. A side of the piston means is exposed to hydrostatic pressure from the sea when the system is submerged.

The control valves further comprise means for holding the piston means in the closed position thereof. This means for holding the piston means may be characterized by a spring bearing on the side of the piston means or may be characterized by a shear pin extending between the body and the piston means.

More specifically, the grout control valve preferably comprises body means for connecting to a grout line, body means defining a central opening therethrough with a shoulder therein, an inlet in communication with the central opening, an outlet in communication with the central opening and a pressure equalizing port in communication with the central opening. The grout control valve further comprises a piston disposed in the central opening with the piston being initially in a closed position adjacent to the shoulder. The piston in the grout control valve has a side in communication with the inlet and an opposite side in communication with the pressure equalizing port. When submerged, hydrostatic pressure is applied to the piston through the equalizing port, tending to keep the piston in its closed position.

In the grout control valve, sealing means may be provided on the piston for providing sealing engagement between the piston and the body means on opposite sides of the outlet when the piston is in its closed position. A stop may be provided in the body means for limiting piston movement therein, and this stop may be characterized by a surface of an end plug at an end of the body means. Preferably, the end plug defines the pressure equalizing port therethrough.

The inflation valve comprises body means for connecting to an inflation line, the body means defining a central opening therethrough with a shoulder therein, an inlet in communication with the central opening, an outlet in communication with the central opening and a pressure equalizing port in communication with the central opening. The inflation valve further comprises a piston disposed in the central opening and having a closed position adjacent to the shoulder. The piston in the inflation valve defines a passage therein in communication with the outlet when the piston is in an open position. The piston has a side in communication with the inlet of the inflation control valve and an opposite side in communication with the pressure equalizing port. When submerged, hydrostatic pressure is applied to the piston through the pressure equalizing port, tending to keep the piston in its closed position.

In the inflation valve, biasing means, such as a spring, may be disposed in the body means for biasing the piston toward the closed position thereof. The force exerted by the biasing means is in addition to the force exerted by the hydrostatic pressure on the piston.

The inflation valve may further comprise sealing means on the piston for providing sealing engagement between the piston and the body means on opposite sides of the outlet when the piston is in either the open or closed position thereof.

Preferably, the inflation valve further comprises check valve means disposed in the passage in the piston for preventing flow through the passage from the outlet to the inlet. Thus, stated in another way, the inflation valve preferably comprises body means for connecting to an inflation line at an inlet thereof and further defining an outlet, piston means for moving in the body means and providing communication between the inlet and outlet when in an open position and preventing communication between the inlet and outlet when in a closed position, and a check valve disposed in the piston means for allowing flow therethrough from the inlet to the outlet while preventing flow therethrough from the outlet to the inlet when the piston means is in the open position.

The check valve means may be characterized by a check valve comprising a valve member and a spring disposed in the passage in the piston means.

As with the grout control valve, the inflation control valve may comprise a stop for limiting movement of the piston in the body means, and the stop may be characterized by a surface of a plug at an end of the body means. Again, the plug may define the pressure equalizing port therethrough.

Stated more broadly, the subsea inflation and grout system of the present invention comprises a jacket positionable on a sea floor, a pile positionable in the jacket such that an annulus is defined therebetween, a packer disposed at a lower end of the jacket for closing the annulus when the packer is inflated, the inflation control valve attached to the jacket, an inflation line connected to the inlet of the inflation control valve, the grout control valve connected to the annulus, and a grout line connected to the inlet of the grout control valve.

An important object of the present invention is to provide a subsea inflation and grout system having control valves with pistons therein which cannot be prematurely or accidentally shifted by hydrostatic pressure from the sea.

An additional object of the invention is to provide a grout control valve or inflation control valve with a piston therein which is pressure balanced in the event of damage to the corresponding grout or inflation line.

A further object of the invention is to provide an inflation control valve having check valve means mounted in a piston in the control valve.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
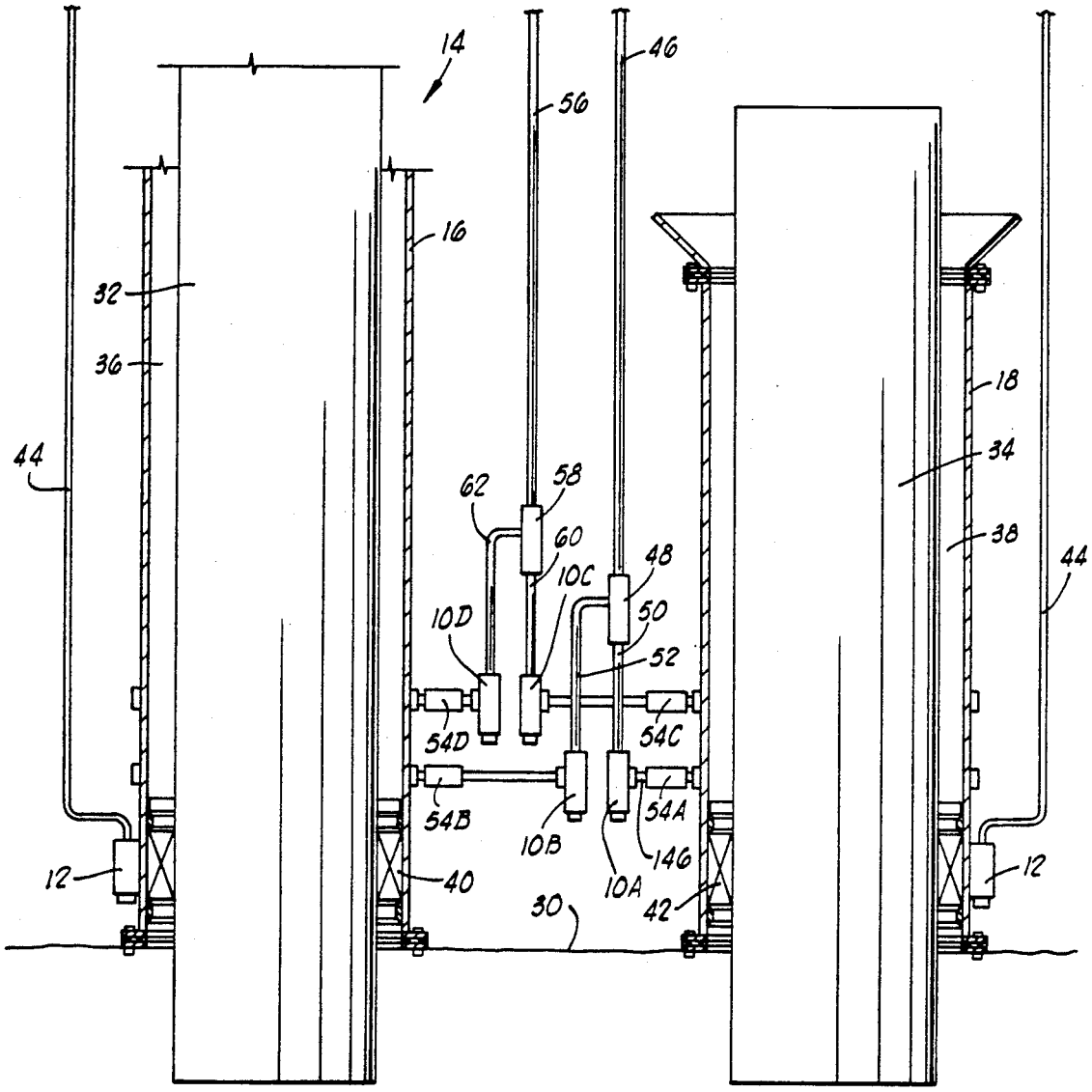
FIG. 1 shows the subsea inflation and grout system of the present invention connected to a single jacket leg and skirt sleeve.
Figure 2:
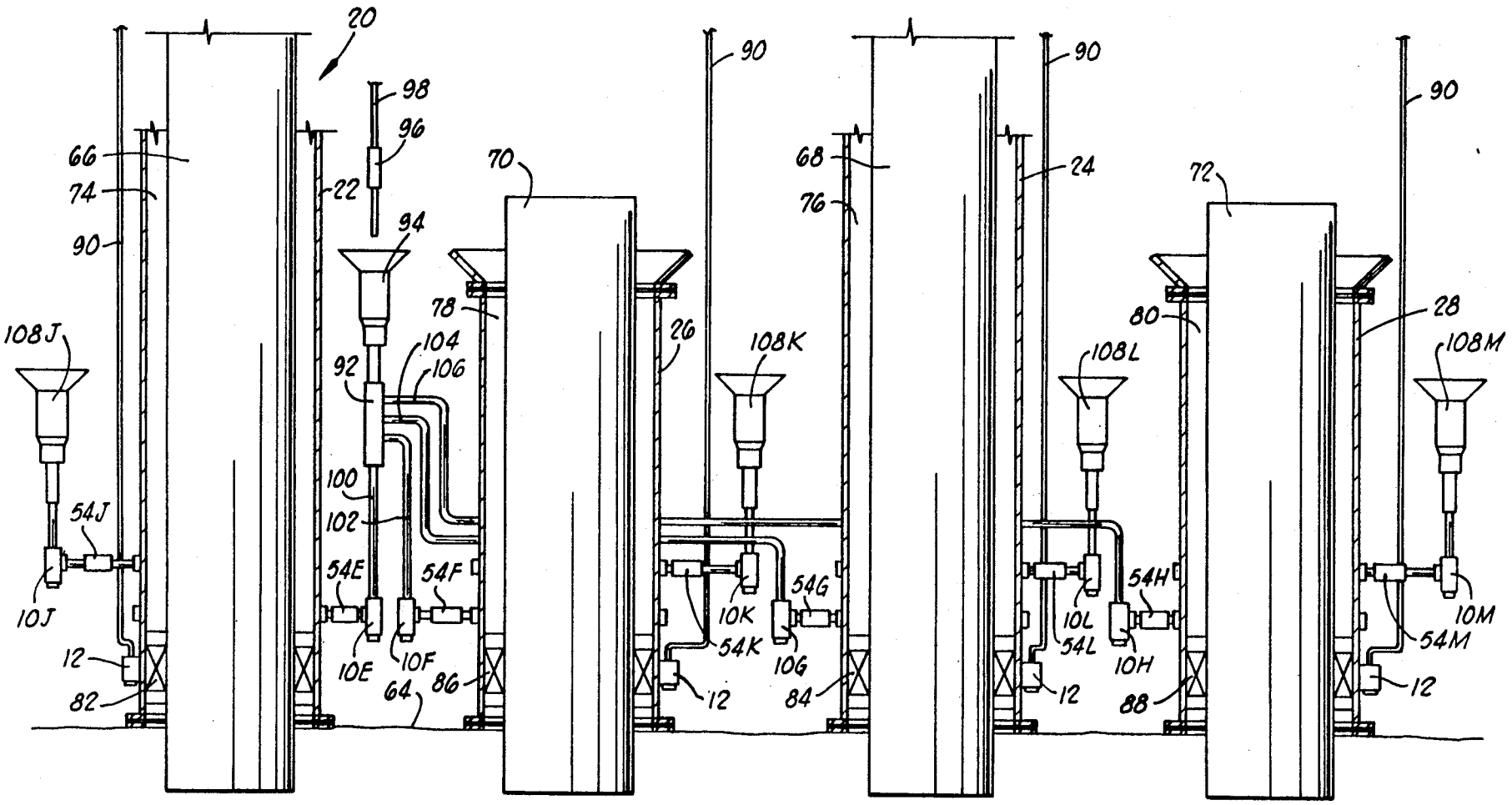
FIG. 2 illustrates the inflation and grout system connected to a pair of jacket legs and a pair of skirt sleeves

Referring now to the drawings, and more particularly to FIGS. 1 and 2, the subsea inflation and grout system of the present invention is shown and includes grout control valves 10 and inflation check and control valves 12, also referred to simply as inflation control valves 12. In FIG. 1, the system is connected to a leg assembly, generally designated by the numeral 14, having a single jacket leg 16 and a skirt jacket or sleeve 18. In FIG. 2, the system is shown connected to a leg assembly 20 having a pair of jacket legs 22 and 24 and skirt jackets or sleeves 26 and 28. Actually, leg assemblies 14 and 20 are generally only examples of portions of larger leg assemblies which can use any number of jacket legs and any number of skirt sleeves for each jacket leg, as desired. FIGS. 1 and 2 merely illustrate two configurations and usages of the inflation and grout system of the present invention.

Referring to FIG. 1, after leg assembly 14 has been set on a sea floor or bottom 30, a leg pile 32 is positioned within jacket leg 16 and driven into sea floor 30. Similarly, a skirt or sleeve pile 34 is positioned in the skirt sleeve 18 and also driven into sea floor 30. An annular space 36 is thus formed between jacket leg 16 and leg pile 32, and a similar annular space 38 is defined between skirt sleeve 18 and skirt pile 34.

At the lower end of jacket leg 16 is an inflatable packer 40, which when inflated as further described herein, closes off the lower end of annular space 36. Another inflatable packer 42 is positioned at the lower end of skirt sleeve 18 and, when inflated, closes off the lower end of annular space 38.

As will be described in more detail herein, an inflation control valve 12 is attached to the lower end of jacket leg 16 so that it is in communication with inflatable packer 40. An inflation line 44 from the surface is attached to inflation control valve 12. Another inflation control valve 12 is attached to the lower end of skirt sleeve 18 and is in communication with inflatable packer 42. Another inflation line 44 extends from the surface to the inflation control valve 12 attached to skirt sleeve 18.

A primary grout line 46 extends from the surface and is connected to a single sleeve grouting valve 48 of a kind known in the art. Grouting valve 48 has first and second grout discharge lines 50 and 52 extending therefrom. First grout discharge line 50 is in communication with the inlet of grout control valve 10A. The outlet of grout control valve 10A is connected to annular space 38 in skirt sleeve 18 through a grout check valve 54A. Similarly, second grout discharge line 52 is in communication with the inlet of grout control valve 10B, and grout control valve 10B is connected to annular space 36 in jacket leg 16 through another grout check valve 54B. All grout check valves 54 are of a kind known in the art. Under some conditions, grout check valves 54 may not be needed at all locations. Of course, grout discharge lines 50 and 52 could be reversed.

A secondary grout line 56 may be provided to extend from the surface to a secondary grouting valve 58. Secondary grout line 56 and secondary grouting valve 58 form part of an essentially duplicate grouting system which includes first and second grout discharge lines 60 and 62, grout control valves 10C and 10D, and grout check valves 54C and 54D. Thus, a second grouting system is provided as an optional backup for the primary grouting system previously described.

Referring now to FIG. 2, the details of leg assembly 20 and the inflation and grout control system therefor are shown and are very similar to that for leg assembly 14 shown in FIG. 1. As seen in FIG. 2, after leg assembly 20 has been set on a sea floor or bottom 64, leg piles 66 and 68 are positioned in jacket legs 22 and 24, respectively, and driven into sea floor 64. Skirt piles 70 and 72 are positioned in skirt sleeves 26 and 28, respectively, and also driven into sea floor 64. Thus, annular spaces 74, 76, 78 and 80 are defined in jacket legs 22 and 24 and skirt sleeves 26 and 28, respectively. Inflatable packers 82, 84, 86 and 88 are positioned in the lower ends of the corresponding jacket legs and skirt sleeves to seal off the bottom of annular spaces 74, 76, 78 and 80, respectively.

An inflation control valve 12 is attached to the lower end of jacket legs 22 and 24 and skirt sleeves 26 and 28, and each inflation control valve 12 is in communication with one of packers 82, 84, 86 and 88. An inflation line 90 extends from the surface to each of inflation control valves 12. Alternatively, all inflation lines 90 could be joined and extend upwardly as a single line.

A triple sleeve grouting valve 92 has a primary grout receptacle 94 connected thereto. Both grouting valve 92 and grout receptacle 94 are of a kind known in the art. Grout receptacle 94 is adapted for receiving a grout stinger 96, also known in the art, at the end of a grout line 98 which extends to the surface. Alternatively, grouting valve 92 could be connected to a grout line to the surface, in a manner similar to the system shown in FIG. 1.

Extending from grouting valve 92 are first, second, third and fourth grout discharge lines 100, 102, 104 and 106 which are in turn in communication with the inlets of grout control valves 10E, 10F, 10G and 10H, respectively. Grout control valves 10E, 10F, 10G and 10H are connected to annular spaces 74, 78, 76 and 80, respectively, through known grout check valves 54E, 54F, 54G and 54H.

As an optional backup to this primary grouting system, secondary grout receptacles 108J, 108K, 108L and 108M are connected to the inlets of grout control valves 10J, 10K, 10L and 10M, and the outlets of the grout control valves are connected to annular spaces 74, 78, 76 and 80, respectively, through grout check valves 54J, 54K, 54L and 54M.

Figure 3:
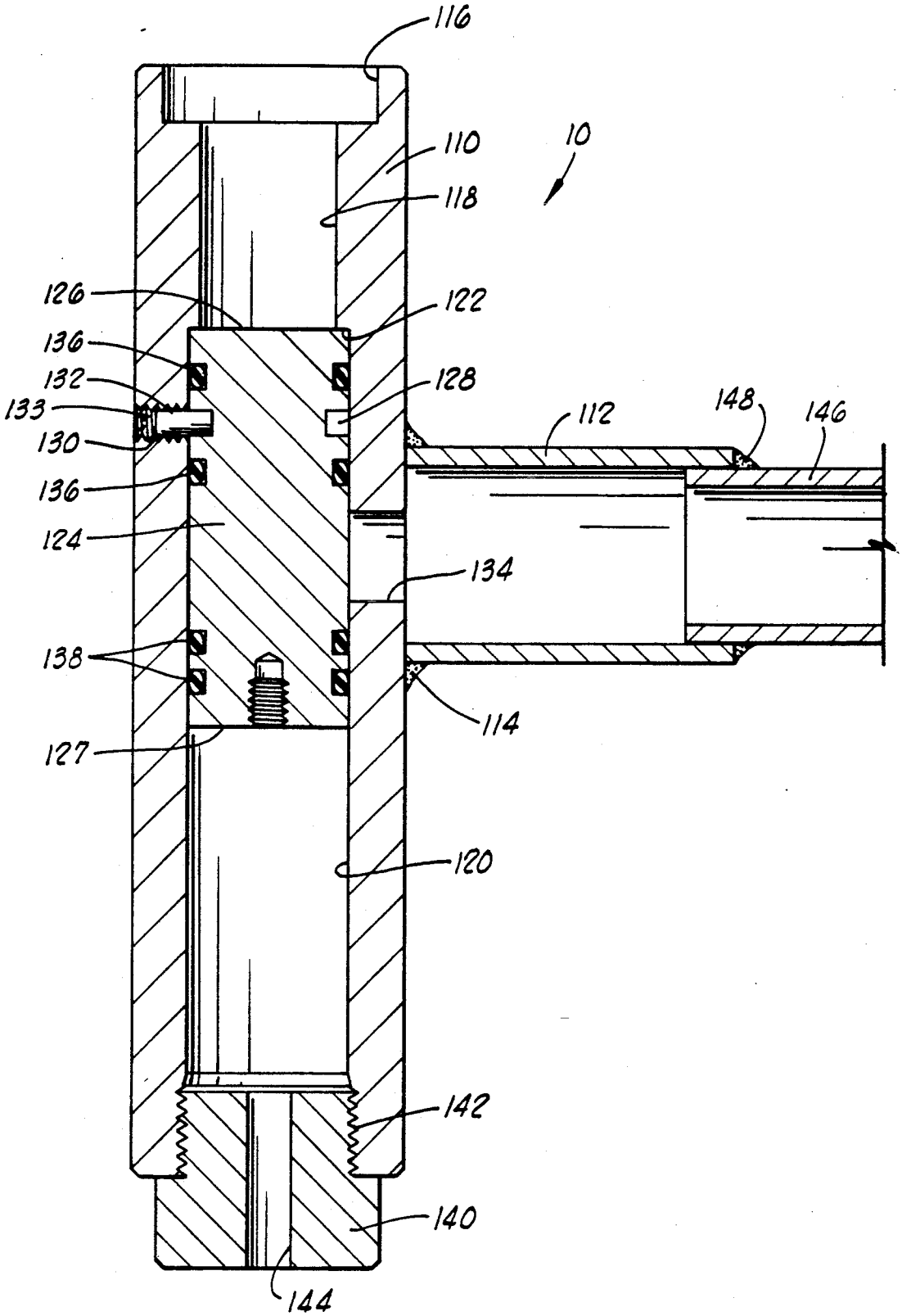
FIG. 3 shows a longitudinal cross section of the grout control valve of the present invention.

Referring now to FIG. 3, the details of grout control valve 10 are shown. Grout control valve 10 comprises body means for connecting to a grout line or grout receptacle. In the embodiment shown, the body means is characterized by a substantially cylindrical body 110 with an outlet nozzle 112 attached thereto, such as by a weld 114.

Body 110 defines a first, inlet bore 116 adapted for receiving a grout line, such as grout discharge line 50 shown in FIG. 1. Body 110 also defines a second bore 118 and a larger third bore 120 such that a generally annular shoulder 122 is formed between the second and third bores. Bores 116, 118 and 120 will be seen to form a central opening in body 110.

Grout control valve 10 also comprises piston means for moving within the body means and controlling the flow of grout therethrough. In the embodiment shown in FIG. 3, the piston means is characterized by a substantially cylindrical piston 124 which is in close spaced relationship to third bore 120 in body 110. Piston 124 has a side or end 126 positioned adjacent to shoulder 122 when in the closed position shown in FIG. 3 and an opposite side or end 127. Piston 124 defines an annular groove 128 therein which is aligned with a threaded hole 130 in body 110. A shear pin 132 is disposed in hole 130 and extends into groove 128 to hold piston 124 in place. A set screw 133 retains shear pin 132.

Body 110 defines a transverse outlet opening 134 therein which is in communication with outlet nozzle 112.

Sealing means, such as O-rings 136 and 138, provide sealing engagement between piston 124 and third bore 120 in body 110 on opposite sides of port 134 when the piston is closed.

Grout control valve 10 also includes an end plug 140 connected to body 110 at threaded connection 142. Cap 140 defines a pressure equalizing port 144 therethrough which is in communication with third bore 120 in body 110.

Outlet nozzle 112 of grout control valve 10 is adapted for engagement with and attachment to a nipple 146 as by a weld 148. Nipple 146 extends between grout control valve 10 and grout check valve 54, as indicated in FIG. 1. Obviously, the length of nipple 146 may vary as necessary.

Figure 4:
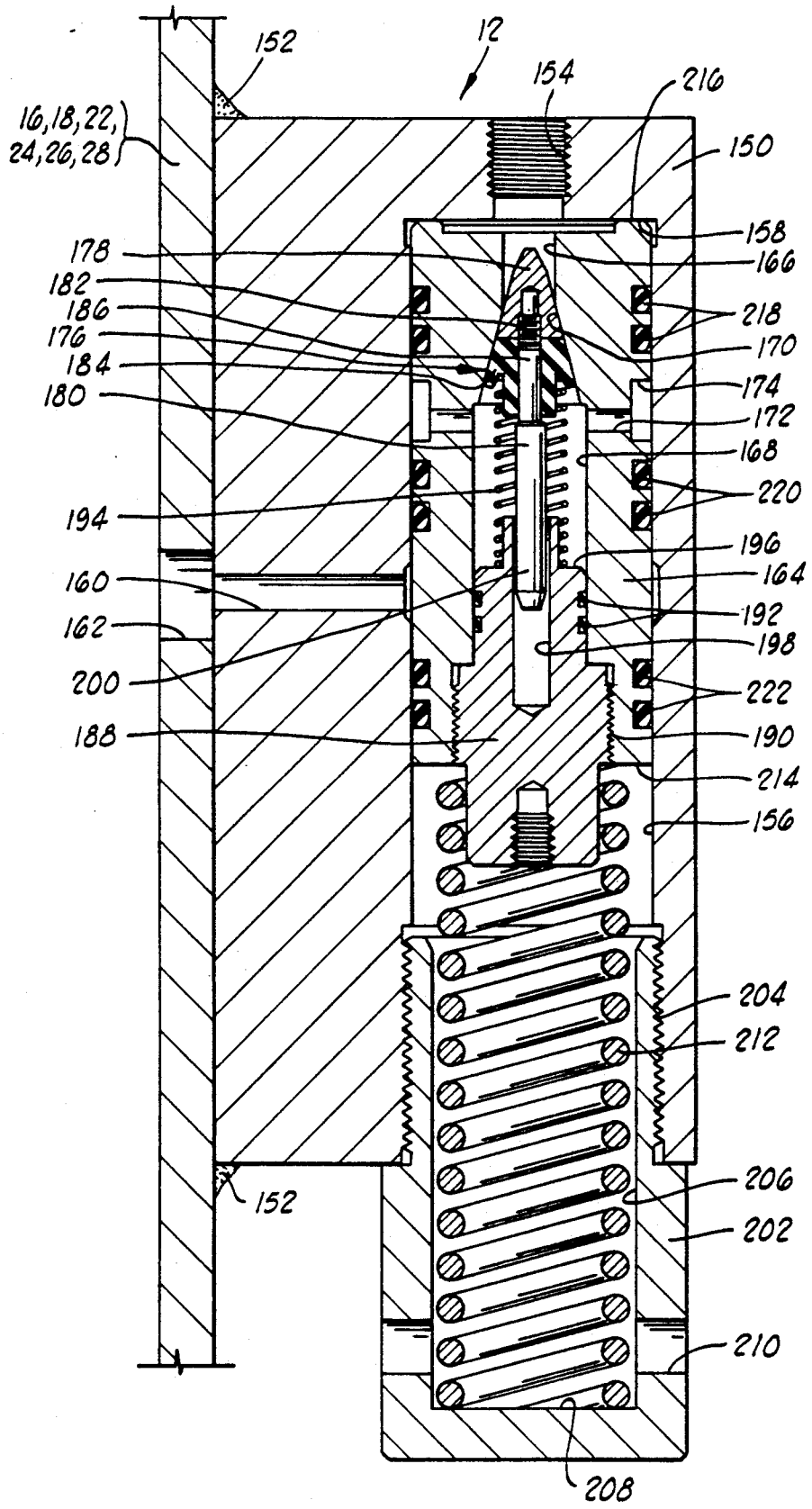
FIG. 4 is a longitudinal cross section of the inflation check and control valve of the present invention.

Referring now to FIG. 4, the details of inflation control valve 12 are shown. Inflation control valve 12 comprises body means for connecting to an inflation line and for attaching to any of the jacket legs or skirt sleeves indicated by the numerals 16, 18, 22, 24, 26 and 28 in FIGS. 1 and 2. In the embodiment shown, the body means is characterized by a body 150 which is attached to a jacket leg or skirt sleeve at weld 152.

Body 150 defines a threaded inlet opening 154 adapted for connection to an inflation line, such as inflation line 44 in FIG. 1. Body 150 defines a bore 156 therein with a generally annular shoulder 158 at one end thereof adjacent to inlet opening 154. Opening 154 and bore 156 will be seen to form a central opening through body 150. Extending transversely in body 150 is an outlet opening 160 which intersects an intermediate portion of bore 156 and is in communication with an inflation port 162 defined in jacket leg 16, 22 or 24 or skirt sleeve 18, 26 or 28. Inflation port 162 is in communication with the corresponding packer 40, 42, 82, 84, 76 or 88 in a manner known in the art.

Piston means are disposed in body 150 for moving therein and controlling flow through inflation control valve 12, and in the embodiment of FIG. 4, piston means is in the form of a substantially cylindrical piston 164 in close, spaced relationship with bore 156 in body 150. Piston 160 defines a first bore 166 therein and a second, larger bore 168. A tapered bore 170 extends between first and second bores 166 and 168. At least one transverse hole 172 extends through piston 164 and provides communication between second bore 168 and an outwardly facing annular groove 174 in the piston.

Check valve means are provided in the piston means for allowing inflation pressure into the packer while preventing reverse flow. In the embodiment shown in FIG. 4, the check valve means is characterized by a check valve assembly, generally designated by the numeral 176. Check valve assembly 176 is substantially the same as in prior art check valves and comprises a valve head 178 attached to a valve stem 180 at threaded connection 182. Check valve assembly 176 also comprises a valve seal 184 which is sealingly positioned on a first portion 186 of valve stem 180 adjacent to valve head 178. As seen in FIG. 4, valve head 178 and valve seal 184 are positioned adjacent to tapered bore 170 in piston 164. Valve seal 184 is adapted for sealing engagement with tapered bore 170 when in the closed position shown.

A piston plug 188 is connected to piston 164 at threaded connection 190. Sealing means, such as O-rings 192, provide sealing engagement between piston plug 188 and second bore 168 in piston 164.

A biasing means, such as spring 194, is disposed in piston 164 for biasing check valve assembly 176 to the closed position shown in FIG. 4. Spring 194 extends between valve seal 184 and a shoulder 196 on piston plug 188.

Piston plug 188 also defines a guide hole 198 which receives an enlarged second portion 200 of valve stem 180, and this engagement guides check valve assembly 176 as it opens and closes.

A spring plug 202 is attached to body 150 at threaded connection 204. Spring plug 202 defines a bore 206 therein with an end surface 208. A transverse pressure equalizing port 210 is defined in spring plug 202 and is in communication with bore 206 in the spring plug, and thus in communication with second bore 156 in body 150.

A biasing means, such as spring 212, is disposed in body 150 adjacent to spring plug 202 for biasing piston 164 to the closed position shown in FIG. 4. Spring 212 extends between surface 208 on spring plug 202 and side or end 214 of piston 164. When in the closed position of piston 164, it will thus be seen that an opposite side or end 216 of the piston is in engagement with shoulder 158 in body 150.

Three sealing means, such as O-rings 218, 220 and 222 provide sealing engagement between piston 164 and bore 156 in body 150. In the closed position of piston 164 shown in FIG. 4, it will be seen that O-rings 220 and 222 provide sealing on opposite sides of outlet opening 160. As will be further described herein, O-rings 218 and 220 provide sealing on opposite sides of outlet opening 160 when piston 164 is in an open position.

OPERATION OF THE INVENTION

Leg assembly 14 and leg assembly 20, and other such leg assemblies, are lowered to sea floor 30 or 64, respectively, with grout control valves 10 and inflation control valves 12 in place as shown and with all of the associated tubing.

Inflation control valve 12 is designed so that hydrostatic pressure in inflation line 44 or 90 cannot shift piston 164 in body 150. Piston 164, containing check valve assembly 176, is held inside body 150 by spring 212 as hereinbefore described. Initially, piston 164 is in the closed position of FIG. 4 where outlet opening 160 is closed with O-rings 220 and 222 sealing on opposite sides thereof.

End 216 of piston 164 is exposed to pressure in inflation line 44 or 90 which is connected to inlet opening 154 in body 150. The opposite end 214 of piston 164 is exposed to hydrostatic pressure through port 210 in spring cap 202. Thus, piston 164 is held in the closed position by spring 212 and the hydrostatic pressure acting on end 214. If piston 164 is shifted before or during launch of the leg assembly, the hydraulic pressure and the spring force will shift this piston back to its closed position.

If inflation line 44 or 90 develops a leak, is ruptured or is torn off the leg assembly during launch or installation, end 216 of piston 164 is exposed to hydrostatic pressure, and it will be seen that the piston thus becomes pressure balanced. The only load on piston 164 at this point is from spring 212, which is designed to be strong enough to close piston 164 should it be shifted.

Grout control valve 10 is also designed so that hydrostatic pressure in any of the grout lines connected thereto cannot shift piston 124 in body 110. Piston 124 is held inside body 110 in the closed position shown in FIG. 3 by shear pin 132 and thus closes off discharge opening 134 which is connected to annulus 36 or 38 in FIG. 1 or annulus 74, 76, 78 or 80 in FIG. 2.

End 126 of piston 124 is exposed to pressure in the grout line connected to inlet bore 116 in body 110. Opposite side 127 of piston 124 is exposed to hydrostatic pressure through port 144 in end plug 140. The hydrostatic pressure keeps piston 124 in the closed position shown in FIG. 3, and if piston 124 is shifted before or during launch of the leg assembly, the hydrostatic pressure will shift the piston back to the closed position.

If the grout line develops a leak, is ruptured or is torn off during launch or installation of the leg assembly, end 126 of piston 124 is exposed to hydrostatic pressure, and it will be seen that the piston is thus pressure balanced. If this occurs, there is no load on piston 124 or shear pin 132 holding it in place, and thus shear pin 132 will not be prematurely sheared or piston 124 moved if the grout line is damaged.

Once leg assemblies 14 or 20 are in position on sea floor 30 or 64, leg piles 32, 66 and 68 and skirt piles 34, 70 and 72 are driven into position. At this point, the corresponding packers 40, 42, 82, 84, 86 and 88 are inflated by pressurizing inflation lines 44 or 90.

Inflation lines 44 or 90 are normally filled with water or a compressed gas, and pressure is applied to shift piston 164 in body 150 of each inflation control valve 12. Piston 164 is moved in body 150 until end 214 of the piston contacts spring cap 202, at which point annular groove 174 and transverse hole 172 is aligned with outlet opening 160. O-rings 218 and 220 then seal on opposite sides of opening 160.

Water or compressed gas is then pumped past check valve assembly 176, by displacing it against spring 194 in a direction toward piston plug 188, and into the packer to inflate the packer sealingly against the previously driven leg or skirt pile. Once the packer is inflated, check valve assembly 176 will be closed by spring 194, thus holding the inflation pressure on the packer.

If water is used to inflate the packer, and the inflation pressure in inflation line 44 or 90 is relieved, spring 212 will shift piston 164 back to the closed position, thereby closing outlet opening 160. If compressed gas is used to inflate the packer, and the inflation pressure in inflation line 44 or 90 is relieved, the force of spring 212 and of the hydrostatic pressure will shift piston 164 back to the closed position.

Once the packers are inflated, grout is pumped to grouting valve 48 in FIG. 1 or 92 in FIG. 2, and the grouting valve sequentially directs grout to the corresponding grout control valves 10 in a manner known in the art. Grouting valve 48 first directs grout to grout control valve 10A and then to grout control valve 10B. In FIG. 2, grouting valve 92 first directs grout to grout control valve 10E and then sequentially directs grout to grout control valves 10F, 10G and 10H in that order.

When grout is pumped to each grout control valve 10, the pressure acting on end 126 of piston 164 is sufficient to cause shear pin 132 to be sheared so that piston 124 may be moved to the open position. End plug 140 limits movement of piston 124. In the open position, outlet nozzle 112 is in communication with the grout line connected to inlet bore 116 in body 110. Grout is then pumped through grout check valve 54 into the corresponding annulus 32, 38, 74, 76, 78 or 80 in a manner known in the art.

If a problem develops with the primary grout system shown in FIGS. 1 and 2, the secondary, backup grout systems are available to pump grout to the annuli.

It will be seen, therefore, that the inflation and grout system of the present invention is well adapted to carry out the ends and advantages mentioned, as well as those inherent therein. While presently preferred embodiments of the apparatus have been shown for the purposes of this disclosure, numerous changes in the arrangement and construction of parts may be made by those skilled in the art. All such changes are encompassed within the scope and spirit of the appended claims.

What is claimed is:

1. A control valve for subsea use comprising:

a body defining an inlet connectable to a pressure line and further defining an outlet; and piston means for moving within said body, said piston means being initially in a closed position preventing communication between said inlet and outlet and movable to an open position providing communication between said inlet and said outlet, a side of said piston means being exposed to hydrostatic pressure from the sea, said hydrostatic pressure urging said piston means toward said closed position.

2. The control valve of claim 1 further comprising a check valve disposed in said piston means for preventing fluid flow from said outlet to said inlet.

3. A grout control valve comprising:

body means for connecting to a grout line, said body means defining a central opening therethrough with a shoulder therein, an inlet in communication with said central opening, an outlet in communication with said central opening and a pressure equalizing port in communication with said central opening; and a piston disposed in said central opening, said piston being initially in a closed position adjacent to said shoulder and having a side in communication with said inlet and an opposite side in communication with said pressure equalizing port;

wherein, when submerged, hydrostatic pressure is applied to said piston through said pressure equalizing port, tending to keep said piston in said closed position.

4. The valve of claim 3 further comprising sealing means on said piston for providing sealing engagement between said piston and said body means on opposite sides of said outlet when said piston is in said closed position.

5. The valve of claim 3 further comprising a shear pin extending from said body means into engagement with said piston for holding said piston in said closed position.

6. The valve of claim 3 further comprising a stop in said body means for limiting piston movement therein.

7. The valve of claim 6 wherein said stop is characterized by a surface of an end plug at an end of said body means.

8. The valve of claim 7 wherein said end plug defines said pressure equalizing port therethrough.

9. An inflation valve comprising:

body means for connecting to an inflation line, said body means defining a central opening therethrough with a shoulder therein, an inlet in communication with said central opening, an outlet in communication with said central opening and a pressure equalizing port in communication with said central opening; and a piston disposed in said central opening and having an initially closed position adjacent to said shoulder, said piston defining a passage therein in communication with said outlet when said piston is moved to an open position, said piston further having a side in communication with said inlet and an opposite side in communication with said pressure equalizing port;

wherein, when submerged, hydraulic pressure is applied to said piston through said pressure equalizing port, tending to keep said piston in said closed position.

10. The valve of claim 9 further comprising a spring disposed in said body means for biasing said piston toward said closed position.

11. The valve of claim 9 further comprising sealing means on said piston for providing sealing engagement between said piston and said body means on opposite sides of said outlet when said piston is in said open and closed positions.

12. The valve of claim 9 further comprising a check valve disposed in said passage in said piston for preventing flow from said outlet to said inlet.

13. The valve of claim 12 wherein said check valve comprises:

a valve member; and a spring for biasing said valve member toward a closed position.

14. The valve of claim 9 further comprising a stop in said body means for limiting piston movement therein.

15. The valve of claim 14 wherein said stop is characterized by a surface of a plug at an end of said body means.

16. The valve of claim 15 wherein said plug defines said pressure equalizing port therethrough.

17. An inflation valve comprising:

body means for connecting to an inflation line at an inlet thereof and further having an outlet; and piston means for moving within said body means and providing communication between said inlet and said outlet when in an open position and preventing communication between said inlet and said outlet when in a closed position; and a check valve disposed in said piston means, said check valve being adapted for allowing fluid flow from said inlet to said outlet through said piston means when said piston means is in said open position and preventing fluid flow from said outlet to said inlet when said piston means is in said open position.

18. The valve of claim 17 wherein said piston means defines a passage therein and said check valve comprises:

a valve member disposed in said passage for sealing engagement with said piston when said valve member is in a closed position; and a spring disposed in said passage for biasing said valve member toward said closed position.

19. A subsea support assembly comprising:

a jacket positionable on a sea floor;

a pile positionable in said jacket such that an annulus is defined therebetween;

a packer disposed at a lower end of said jacket for closing said annulus when said packer is inflated;

an inflation control valve comprising:

a body attachable to said jacket and defining an outlet in communication with said packer and further defining an inlet; and a piston disposed in said body, said piston having an initially closed position preventing communication between said inlet and said outlet and being slidable to an open position providing communication between said inlet and said outlet for inflating said packer, said piston being exposed to sea hydrostatic pressure on a side thereof opposite said inlet;

an inflation line connected to said inlet of said body of said inflation control valve;

a grout control valve comprising:

a body defining an outlet in communication with said annulus at a position above said packer and further defining an inlet; and a piston disposed in said body, said piston having an initially closed position preventing communication between said inlet of said grout control valve and said outlet of said grout control valve and being slidable to an open position providing communication between said inlet of said grout control valve and said outlet of said grout control valve, said piston in said grout control valve being exposed to sea hydrostatic pressure on a side thereof opposite said inlet of said grout control valve; and a grout line connected to said inlet of said body of said grout control valve.

20. The apparatus of claim 19 further comprising a check valve disposed in said piston of said inflation control valve for preventing flow from said outlet of said inflation control valve to said inlet of said inflation control valve regardless of the position of said piston in said inflation control valve.

21. A control valve for subsea use comprising:

a body defining an inlet connectable to a pressure line and further defining an outlet;

piston means for moving within said body, said piston means being initially in a closed position preventing communication between said inlet and outlet and movable to an open position providing communication between said inlet and outlet, a side of said piston means being exposed to hydrostatic pressure from the sea, said hydrostatic pressure urging said piston means toward said closed position; and means for releasably holding said piston means in said closed position, said holding means being released in response to pressure in said pressure line.

22. The control valve of claim 21 wherein said means for holding said piston means is characterized by a spring bearing on a side of said piston means.

23. The control valve of claim 21 wherein said means for holding said piston means is characterized by a shear pin extending between said body and said piston means.

24. A subsea support assembly comprising:

a jacket positionable on a sea floor;

a pile positionable in said jacket such that an annulus is defined therebetween;

a packer disposed at a lower end of said jacket for closing said annulus when said packer is inflated;

an inflation control valve comprising:

a body attachable to said jacket and defining an outlet in communication with said packer and further defining an inlet;

a piston disposed in said body, said piston having an initially closed position preventing communication between said inlet and said outlet and being slidable to an open position providing communication between said inlet and said outlet for inflating said packer, said piston being exposed to sea hydrostatic pressure on a side thereof opposite said inlet; and a spring disposed in said body for biasing said piston toward said closed position thereof;

an inflation line connected to said inlet of said body of said inflation control valve;

a grout control valve comprising:

a body defining an outlet in communication with said annulus at a position above said packer and further defining an inlet; and a piston disposed in said body, said piston having an initially closed position preventing communication between said inlet of said grout control valve and said outlet of said grout control valve and being slidable to an open position providing communication between said inlet of said grout control valve and said outlet of said grout control valve, said piston in said grout control valve being exposed to sea hydrostatic pressure on a side thereof opposite said inlet of said grout control valve; and a grout line connected to said inlet of said body of said grout control valve.

25. A subsea support assembly comprising:

a jacket positionable on a sea floor;

a pile positionable in said jacket such that an annulus is defined therebetween;

a packer disposed at a lower end of said jacket closing said annulus when said packer is inflated;

an inflation control valve comprising:

a body attachable to said jacket and defining an outlet in communication with said packer and further defining an inlet; and a piston disposed in said body, said piston having an initially closed position preventing communication between said inlet and said outlet and being slidable to an open position providing communication between said inlet and said outlet for inflating said packer, said piston being exposed to sea hydrostatic pressure on a side thereof opposite said inlet;

an inflation line connected to said inlet of said body of said inflation control valve;

a grout control valve comprising:

a body defining an outlet in communication with said annulus at a position above said packer and further defining an inlet;

a piston disposed in said body, said piston having an initially closed position preventing communication between said inlet of said grout control valve and said outlet of said grout control valve and being slidable to an open position providing communication between said inlet of said grout control valve and said outlet of said grout control valve, said piston in said grout control valve being exposed to sea hydrostatic pressure on a side thereof opposite said inlet of said grout control valve; and a shear pin disposed in said grout control valve for holding said piston therein in said closed position thereof; and a grout line connected to said inlet of said body of said grout control valve.

* * * * *